US005159964A

United States Patent [19]

Baker et al.

[11] Patent Number: 5,159,964

[45] Date of Patent: Nov. 3, 1992

[54] TOOL AND METHOD FOR HANDLING COLLECTABLE CARDS

[76] Inventors: Paul N. Baker, 8080 S.W. 24th Pl., Miramar, Fla. 33025; Michael C. Messineo, 13650 Roanoke St., Davie, Fla. 33325; Milo J. Valencic, 7111 SW. 33rd Ct., Davie, Fla. 33314

[21] Appl. No.: 627,848

[22] Filed: Dec. 14, 1990

[51] Int. Cl.[5] ..... A45C 11/18; B25B 7/00

[52] U.S. Cl. ..... 150/147; 206/455

[58] Field of Search ..... 150/147, 149, 145, 148, 150/133; 206/39, 39.6, 38; 284/16, 25, 33

[56] References Cited

U.S. PATENT DOCUMENTS

| | | | |
|---|---|---|---|
| 378,119 | 2/1888 | Trowbridge | 206/39 |
| 1,585,051 | 5/1926 | Skoglund | 150/149 X |
| 1,671,298 | 5/1928 | L'Enfant | 150/147 |
| 1,832,625 | 11/1931 | Gardner, Jr. | 150/149 X |
| 2,020,797 | 11/1935 | Pabst, Jr. | 150/149 X |
| 2,252,177 | 8/1941 | Heyer | 150/145 X |
| 2,468,817 | 5/1949 | Duchin | 206/39 |
| 2,771,928 | 11/1956 | Hoeflin | 206/38 |
| 3,068,923 | 12/1962 | Wolf | 150/145 X |
| 3,410,592 | 11/1968 | Schweizer | 294/33 X |
| 3,558,169 | 1/1971 | Onanian | 294/33 X |
| 3,565,148 | 2/1971 | Miller | 150/147 |
| 3,848,906 | 11/1974 | Fleishman | 294/16 X |
| 3,947,063 | 3/1976 | Webster et al. | 294/16 |
| 4,037,634 | 7/1977 | Ricciardi | 150/133 |
| 4,141,400 | 2/1979 | Mangan | 150/147 X |
| 4,711,347 | 12/1987 | Drexler et al. | 206/38 |
| 4,741,372 | 5/1988 | Santilli | 150/137 |
| 4,934,520 | 6/1990 | Okada | 150/147 X |
| 4,938,515 | 7/1990 | Fazio | 294/25 |

FOREIGN PATENT DOCUMENTS

| | | | |
|---|---|---|---|
| 574489 | 7/1924 | France | 206/39 |
| 630535 | 12/1927 | France | 206/39 |

*Primary Examiner*—Sue A. Weaver
*Attorney, Agent, or Firm*—Oltman and Flynn

[57] ABSTRACT

A tool is for the handling of sports and other collectible cards and inserting them into protective envelopes without damage to the corners or edges of the cards. The envelopes may be any of several types available on the market today. The tool includes two panels for gripping a card, which are joined in hinged fashion at one end and which have notches formed into their free ends. To use the tool, a card is gripped between the free ends of the panels and inserted together with the free ends into an envelope or pocket. Then a finger is placed against the envelope over the location of the panel notches to grasp the card within the envelope. Then the tool is withdrawn from the envelope or pocket. This tool and method prevents physical damage to the corners and edges of the card during the insertion process.

7 Claims, 3 Drawing Sheets

TOOL AND METHOD FOR HANDLING COLLECTABLE CARDS

BACKGROUND OF THE INVENTION

1. Field of the Invention

The present invention relates generally to the field of storing baseball, football, basketball and other collectible cards, and more specifically to a tool for handling and inserting the collectible cards into a protective envelope, without causing damage to the corners or edges of the collectible cards.

2. Description of the Prior Art

A variety of protective envelopes for cards is found in the prior art. Such envelopes protect the cards from dust, dirt and physical damage. They are typically made of a transparent plastic for ready viewing and identification of the cards they contain. However, no means exist to protect the corners or edges of the collectible cards during the insertion process into the protective envelopes. A damaged corner or edge can result in a 50 percent reduction in the value of a collectible card.

An early example of a protective envelope for cards is that of L'Enfant, U.S. Pat. No. 1,671,298, issued May 29, 1928. L'Enfant discloses a card case made up of several protective envelopes bound together in book fashion and having a surrounding cover. To permit withdrawal of the cards, a cut-away section is provided at the open edge of each envelope in the form of a notch which reveals a portion of the card edge. However, L'Enfant's design is for a storage card of the type attached to a wallet. The notch permits grasping the cards for removal from the envelope and no means is provided for protecting the corners or edges of the cards during insertion into the envelope.

A similar though more recent design of a multi-envelope card holder is disclosed in Santilli, U.S. Pat. No. 4,741,372 issued May 3, 1988. Santilli discloses separate envelopes for containing individual cards which in turn are contained within larger envelopes. The separate envelopes, in fact, are provided with the same notch found in L'Enfant to permit grasping an edge of the cards with one's fingers. The notch permits one to pull out cards for everyday use. However, no means is provided to protect the cards corners or edges while inserting into Santilli's notched envelope.

Another variation, in the form of a single card holder, is taught in Drexler, U.S. Pat. No. 4,711,347, issued Dec. 8, 1987. Drexler teaches a plastic envelope for retaining a data card. One face of this envelope is formed of a hinged panel which lays down in overlapping manner on top of two edge strips and is removably bonded to these edge strips with an adhesive. One can thus lift the hinged panel to reveal the surface of the card and then lay the panel down again so that it re-adheres to the edge strips. Drexler thereby provides access to the information storage area of a data card while the card remains in the protective envelope. The problem, once again, is that Drexler provides no means for inserting a card into the envelope without potential damage. However, this type of protective envelope permits the reading and writing of electronic data while enclosed in its protective envelope. Yet Drexler is merely an electronic data protector and is not used as a tool to insert a card into a final storage place.

Another example of the single card holder is found in Mangan, U.S. Pat. No. 4,141,400, issued Feb. 27, 1979. Mangan discloses a holder open at one edge and having stiff ribs on its inner walls. The magnetic strip of a data card slides between these ribs when the card is inserted into the holder. The magnetic strip is thus protected from mechanical damage caused by contact with a wall of the holder. Once again, a notch is provided in the open edge of the holder for grasping the card for removal. However, the corners or edges are not protected during insertion.

It is thus an object of the present invention to provide a tool and method which permits insertion of cards without potential damage to their corners or edges which will cause the value of the collectible card to be significantly decreased.

It is another object of the present invention to provide a tool as described above which is compact and inexpensive.

It is finally an object of the present invention to provide such a tool which is specifically suited for protecting any collectible card during the insertion process into an envelope.

SUMMARY OF THE INVENTION

The present invention accomplishes the above-stated objectives as well as others, as may be determined by a fair reading and interpretation of the entire specification.

A tool is provided for inserting a collectible card into an envelope having an open edge, without damaging the card. This tool includes two substantially parallel flexible panels, each having a free end and being resiliently spaced from each other at their free ends. The width of the free ends is shorter than that of the open edge of the envelope, so that the free ends can fit into the envelope. Closing the free ends with the card therebetween results in grasping of the card for insertion into the envelope. Also, notches are provided in the free ends of the panels. These notches permit gripping the card between the walls of the envelope when the tool is withdrawn. A sheet of envelopes for containing cards may be provided in place of the single envelope.

BRIEF DESCRIPTION OF THE DRAWINGS

Various other objects, advantages, and features of the invention will become apparent to those skilled in the art from the following discussion taken in conjunction with the following drawings, in which.

DESCRIPTION OF THE PREFERRED EMBODIMENTS

Figure 1:
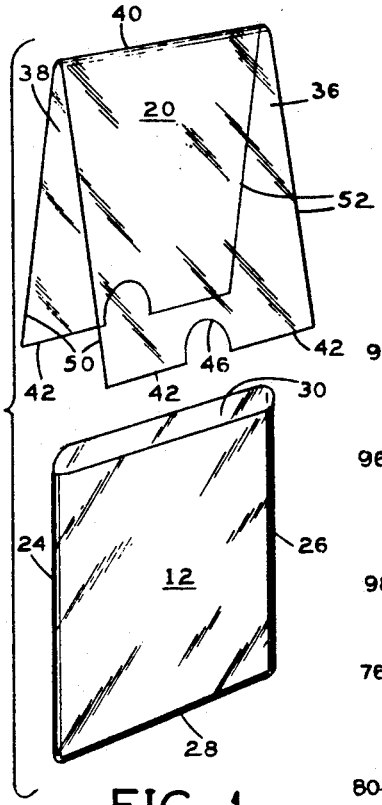
FIG. 1 is a perspective view of the first embodiment of the invention illustrating the use of the inventive tool in conjunction with a single protective envelope.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figures 5, 6, 7:
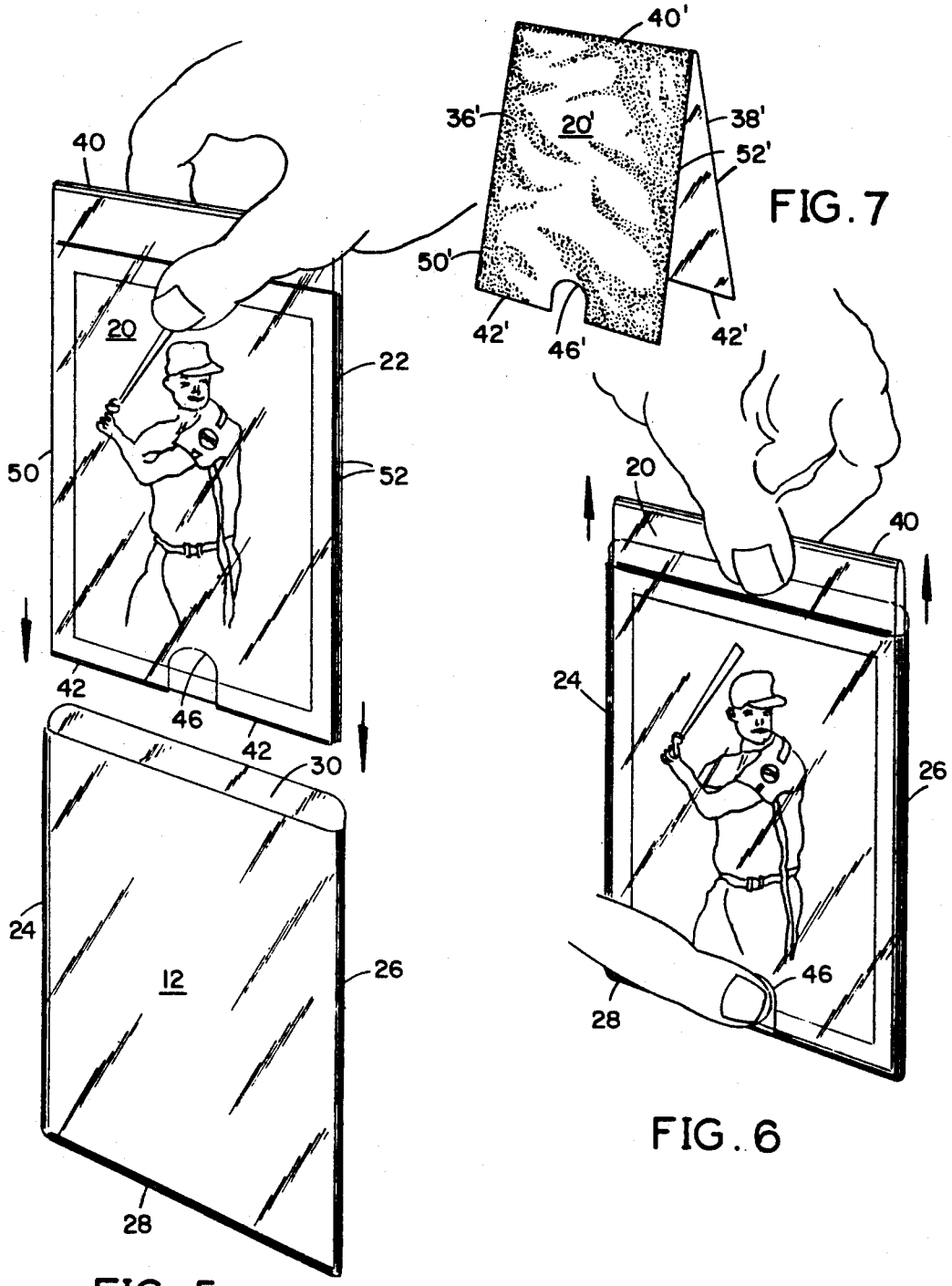
FIG. 5 is a perspective view of the first embodiment illustrating the method of card insertion.
FIG. 6 is a perspective view of the first embodiment illustrating the method of tool removal.
FIG. 7 is a perspective view of a modified tool showing roughened surfaces on the tool.

Referring now in general to the various FIGURES of the drawings, and in particular to FIG. 1, a typical protective, card holding envelope 12 and an inventive card handling tool 20 is disclosed. Referring to FIG. 5, tool 20 is used to grip a collectible card 22 in order to insert it into the protective envelope 12.

Envelope 12 is rectangular and made of flexible, transparent plastic with three fused edges 24, 26, and 28, and open edge 30. See FIG. 1. At least one envelope currently available on the market has these characteristics.

Tool 20 is comprised of panels 36 and 38 which are formed from a single plastic sheet which is folded over itself at its middle without being totally creased to allow a spring action. This folded middle is hereinafter referred to as hinged end 40; see FIG. 1. The ends of panels 36 and 38 opposite hinged end 40 are free, and are hereinafter referred to as free ends 42. The width of each free end 42 is less than that of open edge 30 of each envelope 12. This assures that free ends 42 will fit inside envelope 12 through open edge 30. An open-ended notch 46 is cut into the middle of each free end 42. The combined lengths of sides 50 and 52 of panels 36 and 38 is preferably at least twice the depth of envelope 12. This assures that when tool 20 is fully inserted into envelope 12, enough of tool 20 will be exposed so that it can be manually grasped for removal as in FIG. 6.

Tool 20 may also comprise a panel 36 and a matching panel 38 which are rectangular and are mechanically joined together at one of their short ends, forming a variation of hinged end 40.

Tool 20 is preferably made of a transparent, flexible plastic which is relatively stiff and resilient. The resiliency of the tool material keeps notched ends 42 slightly separated when no pressure is applied to them.

The outer surfaces of panels 36 and 38 may be roughened by sanding or by equivalent means as shown in FIG. 7. Roughened panel surfaces have been found to slide more easily in and out of the plastic protective envelopes.

Second Preferred Embodiment

Figure 2:
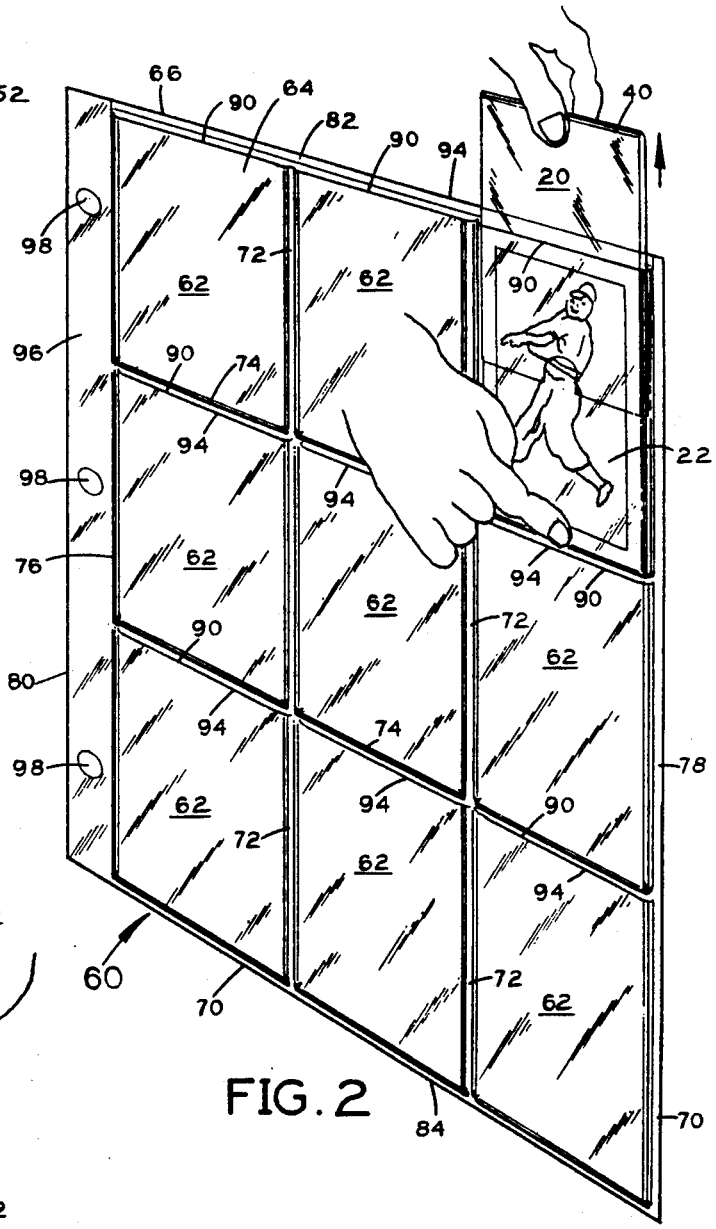
FIGS. 2 and 3 are perspective views of the second embodiment of the invention illustrating the use of the inventive tool in conjunction with a top-loading, multi-envelope card display sheet.
Figure 3:
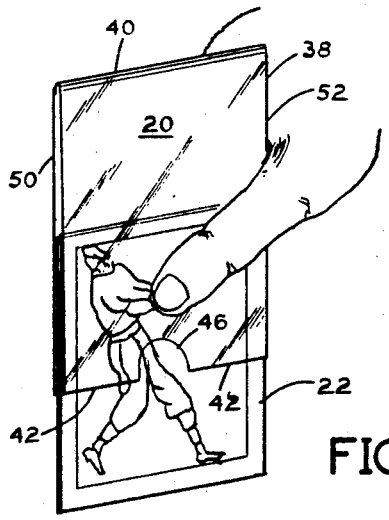

The second preferred embodiment is much like the first except that a top-loading card display sheet 60 in the form of a plurality of joined envelopes 62 is provided in place of envelope 12. See FIGS. 2 and 3. Tool 20 is as described above.

Sheet 60 is a standard type currently commanding about 80 percent of the collectible card storage market. Sheet 60 is formed out of two rectangular layers 64 and 66 of flexible transparent plastic, each having dimensions of approximately 8.5×11 inches. Layers 64 and 66 are fused together face to face at their perimeters along line 70 and also along intersecting perpendicular lines 72 and 74. Perforation sealing is one method currently on the market for a joining means to make sheet 60. Lines 70, 72 and 74 are each approximately one eighth inch wide and together form the closed edges 76 of envelopes 62. Lines 72 and 74 extend parallel to sheet 60 long edges 78 and 80, and sheet 60 short edges 82 and 84, respectively.

Cuts 90 are formed in upper layer 64 immediately adjacent to fused lines 74, to create an open edge 94 in each envelope 62 for receiving a card 22. This means that cuts 90 follow a short edge 82 or 84 of envelope 62. Cuts 90 are made along parallel lines 74 so that a uniform appearance is attained. One long edge 80 of sheet 60 preferably has a half-inch wide lip 96 pierced by a series of notebook binding holes 98. Sheets 60 are assembled together in a notebook binder in sufficient quantity to store all cards 22 in a given collection.

Third Preferred Embodiment

Figure 4:
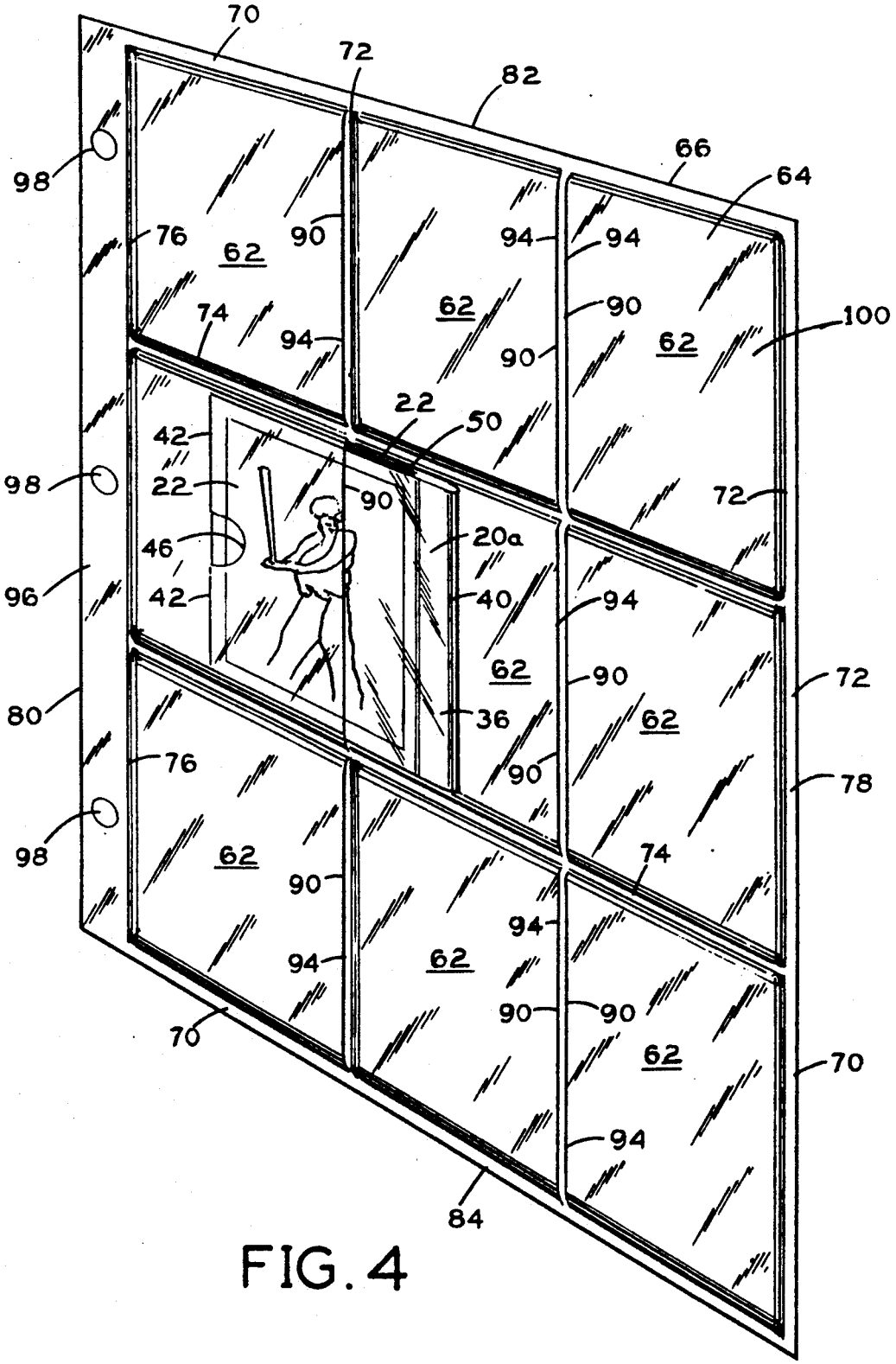
FIG. 4 is a perspective view of the third embodiment of the invention illustrating the side-loading, multi-envelope card display sheet.

The third preferred embodiment is like the second in most respects except that side-loading rather than top-loading cuts are provided in the sheet envelopes. See FIG. 4. Since the side-loading sheets 100 are otherwise the same as sheets 60, the same reference numerals are employed. Tool 20 is re-dimensioned to accommodate the side-loading configuration, and is hereinafter referred to as tool 20*a*.

Like sheet 60, sheet 100 is a standard type currently available on the market. It is formed out of two rectangular layers 64 and 66 of flexible transparent plastic, each having dimensions of approximately 8.5×11 inches. Layers 64 and 66 are fused together face to face at their perimeters along line 70 and also along intersecting perpendicular lines 72 and 74. Lines 70, 72 and 74 are each approximately one eighth inch wide and together form the closed edges 76 of envelopes 62. Lines 72 and 74 extend parallel to sheet 100 long edges 78 and 80, and sheet 100 short edges 82 and 84, respectively.

Cuts 90 are formed in upper layer 64 immediately adjacent to fused lines 72, to create an open edge 94 in each envelope 62 for receiving a card 22. This means that cuts 90 follow a long edge 78 or 80 of sheet 100. Cuts 90 are made along parallel lines 72 so that a uniform appearance is attained. One long edge 80 of sheet 100 preferably has a half-inch wide lip 96 pierced by a series of notebook binding holes 98. Sheets 100 are assembled together in a notebook binder in sufficient quantity to store all cards 22 in a given collection.

Since cuts 90, which form open edges 94 of envelopes 62, follow sheet 100 long edges 78 or 80, card 22 enters along its length. For this reason tool 20*a* must be dimensioned to grip the length rather than the width of card 22. The measure of free ends 42 of tool 20*a* therefore matches the length, rather than the width, of card 22 for this embodiment.

Method

Sheets 60 or 100 are assembled together in a notebook binder in sufficient quantity to store all cards in a given collection. A method of safely handling cards 22 using tool 20 or 20*a* is also provided.

For convenience, this method is explained with reference to the first embodiment; yet it is directed to any embodiments of the present invention. To insert a card 22 into envelope 12, card 22 is first placed between free ends 42 of panels 36 and 38 of too 20. See FIG. 5. Panels 36 and 38 are then pressed together so that they grip card 22. While pressure is maintained on panels 36 and 38, free end 42 is inserted into envelope 12. Free end 42 is inserted to the full depth of envelope 12, which places card 22 completely inside envelope 12, and then pressure on panels 36 and 38 is released. Next, the user's finger or thumb is pressed against envelope 12 directly over notch 46, to cause envelope 12 to grip card 22. See FIG. 6. Tool 20 is then withdrawn while card 22 remains inside envelope 12.

Tool 20 and the above-described methods can be used in conjunction with most other envelopes and sheet pockets found in the prior art. The same safe handling of cards is achieved.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A tool for inserting a collectible card into an envelope having an open edge, without damaging the card comprises, a flexible sheet folded over to include means to create two flexible panels having free ends resiliently spaced apart and a common hinged end, the width of the said free ends being shorter than that of the open edge of the envelope, whereby a grasping of said panels with the card therebetween results in gripping of the card for insertion into the envelope, and a subsequent release of the panels releases the card so that the card remains in the envelope while the tool is withdrawn.

2. A tool as in claim 1 wherein said free ends have a notch cut out of them to reveal a portion of the card when the card is held between said panels.

3. A tool as in claim 1 wherein said flexible panels have outer surfaces, and said outer surfaces are roughened so that they will slide into envelopes with reduced friction resistance.

4. A tool as in claim 1 for use with several envelopes joined together at their edges to form a sheet of envelopes.

5. A tool as in claim 1 wherein said common hinged end is opposite and parallel to said free ends.

6. A tool as in claim 1 wherein the panels are made of a transparent plastic.

7. A tool for inserting a collectible card into an envelope having an open edge, without damaging the card comprises, a sheet folded over to include means to create two flexible panels having free ends resiliently spaced apart and a common hinged end, the width of the said free ends being shorter than that of the open edge of the envelope, whereby a grasping of said panels with the card therebetween results in gripping of the card for insertion into the envelope, and a subsequent release of the panels releases the card so that the card remains in the envelope while the tool is withdrawn, wherein said flexible panels have outer surfaces, and said outer surfaces are roughened so that they will slide into envelopes with reduced friction resistance.

* * * * *